US006975293B2

(12) United States Patent
Yen et al.

(10) Patent No.: US 6,975,293 B2
(45) Date of Patent: Dec. 13, 2005

(54) ACTIVE MATRIX LED DISPLAY DRIVING CIRCUIT

(75) Inventors: Wen-Cheng Yen, Taichung (TW); Yu-Tong Lin, Taichung (TW)

(73) Assignee: Faraday Technology Corp., Hsin-Chu (TW)

( * ) Notice: Subject to any disclaimer, the term of this patent is extended or adjusted under 35 U.S.C. 154(b) by 461 days.

(21) Appl. No.: 10/355,153

(22) Filed: Jan. 31, 2003

(65) Prior Publication Data

US 2004/0150593 A1 Aug. 5, 2004

(51) Int. Cl.[7] ..... G09G 3/32
(52) U.S. Cl. ..... 345/82; 345/84; 345/204; 315/169.1
(58) Field of Search ..... 345/82, 34, 204; 315/169.1, 169.2, 169.3, 169.4

(56) References Cited

U.S. PATENT DOCUMENTS 6,229,506 B1 * 5/2001 Dawson et al. ..... 345/82
6,331,844 B1 * 12/2001 Okumura et al. ..... 345/87
6,351,078 B1 * 2/2002 Wang et al. ..... 315/169.3
6,501,466 B1 * 12/2002 Yamagishi et al. ..... 345/204
6,535,185 B2 * 3/2003 Kim et al. ..... 345/76
6,798,148 B2 * 9/2004 Inukai ..... 315/169.3
6,876,350 B2 * 4/2005 Koyama ..... 345/92
2002/0180369 A1 * 12/2002 Koyama ..... 315/169.1
2004/0129933 A1 * 7/2004 Nathan et al. ..... 257/40

* cited by examiner

*Primary Examiner*—Sumati Lefkowitz
*Assistant Examiner*—Alecia D. Nelson
(74) *Attorney, Agent, or Firm*—Winston Hsu

(57) ABSTRACT

An active matrix LED display driving circuit. The circuit comprises a first transistor having a drain, a source coupled to receive a data signal and a gate coupled to receive a scan signal and, a second transistor having a drain, a source coupled to receive the data signal and a gate coupled to receive the scan signal, a third transistor having a source, a drain coupled to the drain of the second transistor and a gate coupled to the drain of the first transistor, a fourth transistor having a drain coupled to receive a first voltage, and a gate coupled to receive the scan signal and a source coupled to the drain of the second transistor, a light emitting diode having an anode coupled to the source of the third transistor and a cathode coupled to receive a second voltage, and a capacitor coupled between the gate and source of the third transistor.

10 Claims, 3 Drawing Sheets

ACTIVE MATRIX LED DISPLAY DRIVING CIRCUIT

BACKGROUND OF THE INVENTION

1. Field of the Invention

The present invention relates to an active matrix LED display driving circuit and particularly to an organic light emitting diode (OLED) display driving circuit having a simple circuit structure, small circuit area and low power consumption as well as providing a high contrast ratio.

2. Description of the Prior Art

FIG. 1 is a diagram showing a conventional active matrix OLED driving circuit. In each pixel, there are four N-type transistors 11~14, an OLED 15 and a capacitor 16. The transistor 11 has a drain coupled to receive a data signal $I_{Data}$, and a gate coupled to receive a scan signal $V_{select}$. The transistor 12 has a drain coupled to receive the data signal $I_{Data}$, and a gate coupled to receive the scan signal $V_{select}$. The transistor 13 has a drain coupled to the source of the transistor 12, and a gate coupled to the source of the transistor 11. The transistor 14 has a drain and gate commonly coupled to receive a power supply voltage VDD, and a source coupled to the source of the transistor 12. The OLED 15 has an anode coupled to the source of the transistor 13 and a cathode coupled to the ground. The capacitor 16 is coupled between the drain of the transistor 14 and the gate of the transistor 13. Since all the transistors 11~14 are N-type transistors, they can be amorphous Si thin-film transistors (a-Si TFTs).

The capacitor 16 is mainly used for charge storage. During a scan period, the transistors 11 and 12 are turned on by the scan signal $V_{select}$ so that the data signal $I_{Data}$ drives a current through the transistor 13 and charging the capacitor 16. At the end of the scan period, the transistors 11 and 12 are turned off by the scan signal $V_{select}$ so that the current driven by the data signal $I_{Data}$ is cut off. The voltage established by the charges on the capacitor 16 succeeds the data signal $I_{Data}$ to drive the same current through the transistor 13 until the beginning of the next scan period.

The previously described driving circuit has a relatively narrow range of the current through the transistor 13. If a larger data signal $I_{Data}$ is used in order to raise the brightness of the OLED 15, the gate-to-source voltage of the transistor 14 will be increased. The drain-to-source voltage of the transistor 13 will decrease as the transistor 14 increases. Accordingly, the transistor 13 will operate in the linear region rather than saturation region if the data signal $I_{Data}$ is large enough. This adversely pulls down the current through the transistor 13 to drive the OLED 15. If a higher voltage $V_{DD}$ is used for a higher brightness, the transistor 14 in each dark pixel will be mistakenly turned on beyond the scan period since the dark current through the transistor 13 will be too small to maintain a high enough voltage level on the drain of the transistor 13. Therefore, the range of the variation of the current driving the OLED 15 is limited, which lowers the contrast ratio of the display.

FIG. 2 is a diagram showing another conventional active matrix OLED driving circuit. In each pixel, there are four N-type transistors 21~24, an OLED 25 and a capacitor 26. The transistor 21 has a drain coupled to receive a data signal $I_{Data}$, and a gate coupled to receive a scan signal $V_{select}$. The transistor 22 has a drain coupled to receive the data signal $I_{Data}$, and a gate coupled to receive the scan signal $V_{select}$. The transistor 23 has a drain coupled to the source of the transistor 22, and a gate coupled to the source of the transistor 21. The transistor 24 has a drain coupled to receive a power supply voltage $V_{DD}$, a gate coupled to a control signal $V_{ctrl}$, and a source coupled to the source of the transistor 22. The OLED 25 has an anode coupled to the source of the transistor 23 and a cathode coupled to the ground. The capacitor 26 is coupled between the drain of the transistor 24 and the gate of the transistor 23. Since all the transistors 21~24 are N-type transistors, they can be a-Si TFTs.

In the circuit of FIG. 2, the problem in the circuit of FIG. 1 is solved by providing the external control signal $V_{ctrl}$ to the transistor 24 so that the variation range of the driving current is wider. However, this requires additional wiring and circuits for the signal $V_{ctrl}$.

FIG. 3 is a diagram showing still another conventional active matrix OLED driving circuit. In each pixel, there are six N-type transistors 31~34, 37, and 38, an OLED 35, and a capacitor 36. The transistor 31 has a drain coupled to receive a data signal $I_{Data}$, and a gate coupled to receive a scan signal $V_{select}$. The transistor 32 has a drain coupled to receive the data signal $I_{Data}$, and a gate coupled to receive the scan signal $V_{select}$. The transistor 33 has a drain coupled to the source of the transistor 32, and a gate coupled to the source of the transistor 31. The transistor 34 has a drain coupled to receive a power supply voltage $V_{DD}$ and a source coupled to the source of the transistor 32. The OLED 35 has an anode coupled to the source of the transistor 33 and a cathode coupled to the ground. The capacitor 36 is coupled between the drain of the transistor 34 and the gate of the transistor 33. The transistor 37 has a drain and gate commonly coupled to receive the power supply voltage $V_{DD}$, and a source coupled to the gate of the transistor 34. The transistor 38 has a drain coupled to the source of the transistor 37, and a gate coupled to receive the scan signal $V_{select}$ and a source coupled to the ground. The transistors 37 and 38 act as an inverter. Since all the transistors are N-type transistors, they can be a-Si TFTs.

In the circuit of FIG. 3, there are additional transistors used as an inverter to consume more power and have a large circuit area.

SUMMARY OF THE INVENTION

The object of the present invention is to provide an active matrix OLED display driving circuit having a simple circuit structure, small circuit area and low power consumption as well as providing a high contrast ratio.

The present invention provides an active matrix LED display driving circuit. The circuit comprises a first transistor of a first type having a drain, a source coupled to receive a data signal and a gate coupled to receive a scan signal, a second transistor of the first type having a drain, a source coupled to receive the data signal and a gate coupled to receive the scan signal, a third transistor of the first type having a source, a drain coupled to the drain of the second transistor and a gate coupled to the drain of the first transistor, a fourth transistor of the first type having a drain coupled to receive a first voltage, and a gate coupled to receive the scan signal and a source coupled to the drain of the second transistor, a light emitting diode having an anode coupled to the source of the third transistor and a cathode coupled to receive a second voltage, and a capacitor coupled between the gate and source of the third transistor.

The present invention further provides an active matrix LED display driving circuit. The circuit comprises a first transistor of a second type having a source, a drain coupled to receive a data signal and a gate coupled to receive a scan signal, a second transistor of the second type having a source, a drain coupled to receive the data signal and a gate coupled to receive the scan signal, a third transistor of the second type having a source, a drain coupled to the source of the second transistor and a gate coupled to the source of the first transistor, a fourth transistor of the second type having a source coupled to receive a first voltage, and a gate coupled to receive the scan signal and a drain coupled to the source of the second transistor, a light emitting diode having an anode coupled to the source of the third transistor and a cathode coupled to receive a second voltage, and a capacitor coupled between the gate and source of the third transistor.

Thus, in the present invention, the scan signal is directly fed to the gate of the upper transistor in the LED driving current path and the capacitor is moved to be coupled between the gate and source of the lower transistor, which eliminates the necessity of the inverter or additional control signal, and makes it possible to achieve a driving circuit having a simple circuit structure, small circuit area and low power consumption as well as providing a high contrast ratio.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 4:
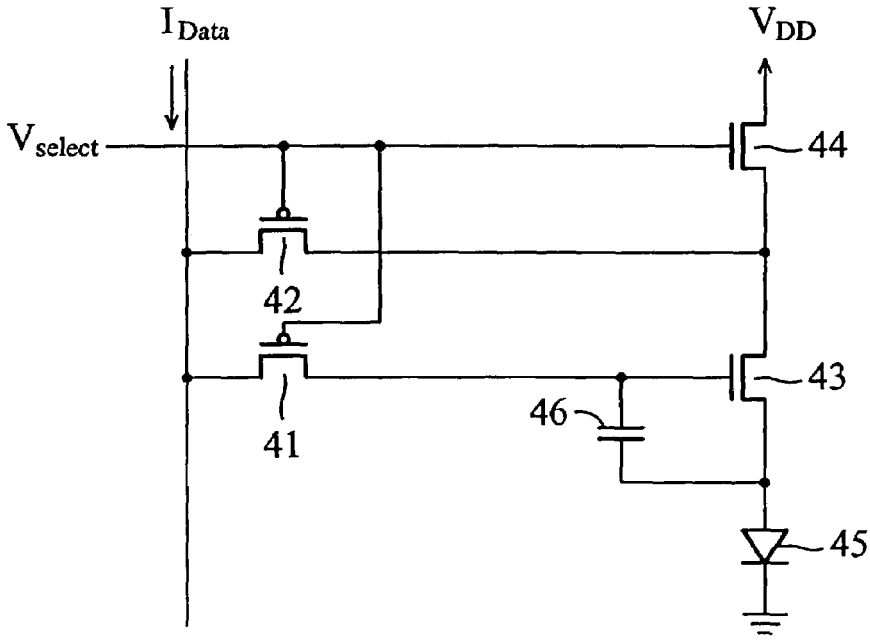
FIG. 4 is a diagram showing an active matrix OLED driving circuit according to a first embodiment of the invention.

FIG. 4 is a diagram showing an active matrix OLED driving circuit according to a first embodiment of the invention. It includes two P-type transistors 41 and 42, two N-type transistors 43 and 44, an OLED 45, and a capacitor 46. The transistor 41 has a source coupled to receive a data signal $I_{Data}$ and a gate coupled to receive a scan signal $V_{select}$. The transistor 42 has a source coupled to receive the data signal $I_{Data}$ and a gate coupled to receive the scan signal $V_{select}$. The transistor 43 has a drain coupled to the drain of the transistor 42 and a gate coupled to the drain of the transistor 41. The transistor 44 has a drain coupled to receive a power supply voltage $V_{DD}$, and a gate coupled to receive the scan signal $V_{select}$ and a source coupled to the drain of the transistor 42. The OLED 45 has an anode coupled to the source of the transistor 43 and a cathode coupled to the ground. The capacitor 46 is coupled between the gate and source of the transistor 43. Since there are two types of transistors in the driving circuit, the transistor may be poly-Si TFTs.

The capacitor 46 is mainly used for charge storage. During a scan period, the transistors 41 and 42 are turned on by the scan signal $V_{select}$ so that the data signal $I_{Data}$ drives a current through the transistor 43 and charging the capacitor 46. At the end of the scan period, the transistors 41 and 42 are turned off by the scan signal $V_{select}$ so that the current driven by the data signal $I_{Data}$ is cut off. The voltage established by the charges on the capacitor 46 succeeds the data signal $I_{Data}$ to drive the same current through the transistor 43 until the beginning of the next scan period.

Figure 1:
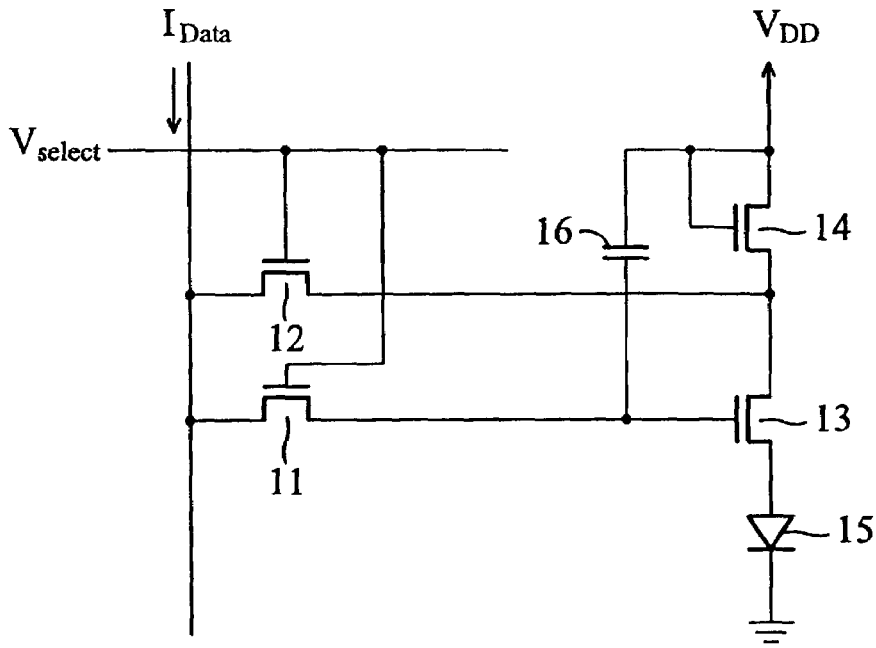
FIG. 1 ( PRIOR ART )
FIG. 1 is a diagram showing a conventional active matrix OLED driving circuit.
Figure 2:
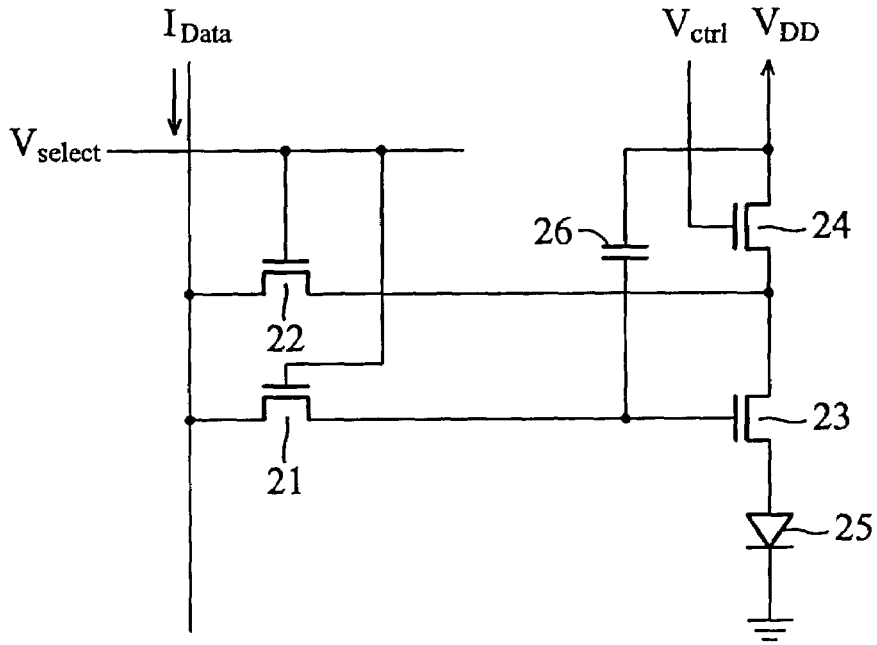
FIG. 2 ( PRIOR ART )
FIG. 2 is a diagram showing another conventional active matrix OLED driving circuit.
Figure 3:
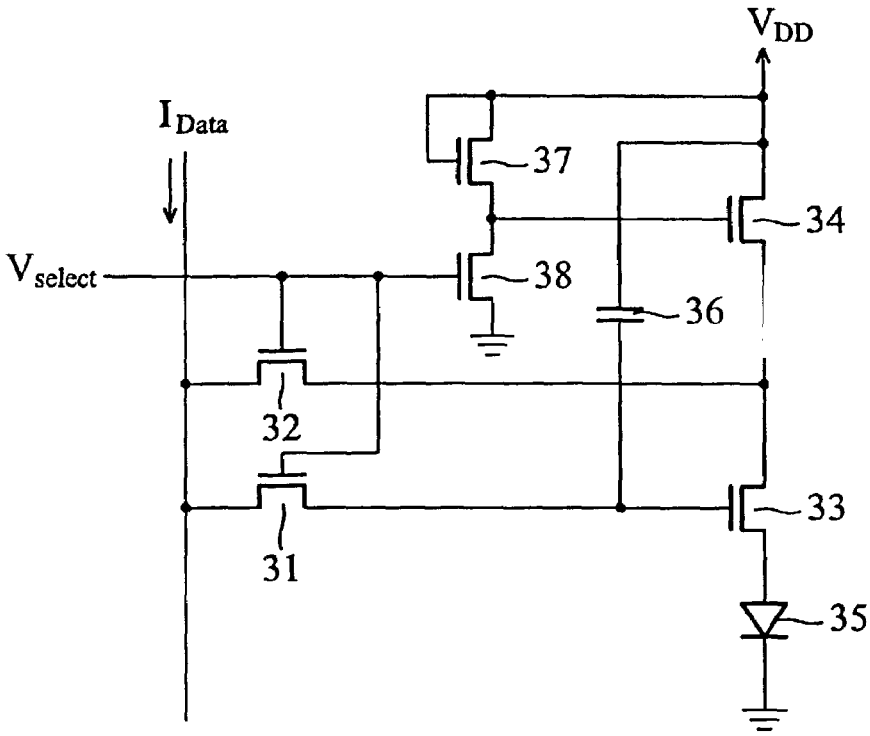
FIG. 3 ( PRIOR ART )
FIG. 3 is a diagram showing still another conventional active matrix OLED driving circuit.

By comparing the driving circuits in FIGS. 3 and 4, it is noted that the inverter composed of two transistors is eliminated in the circuit of FIG. 4. This reduces the circuit area and power consumption. It is also noted that the capacitor is moved to be coupled between the gate and source of the transistor 43. This avoids laying cross lines above the transistors and simplifies the circuit structure. Further, the variation range of the OLED driving current is increased by directly feeding the scan signal to the gate of the transistor 44. In practice, the variation range of the OLED driving current is increased by 10 $\mu$A approximately.

Figure 5:
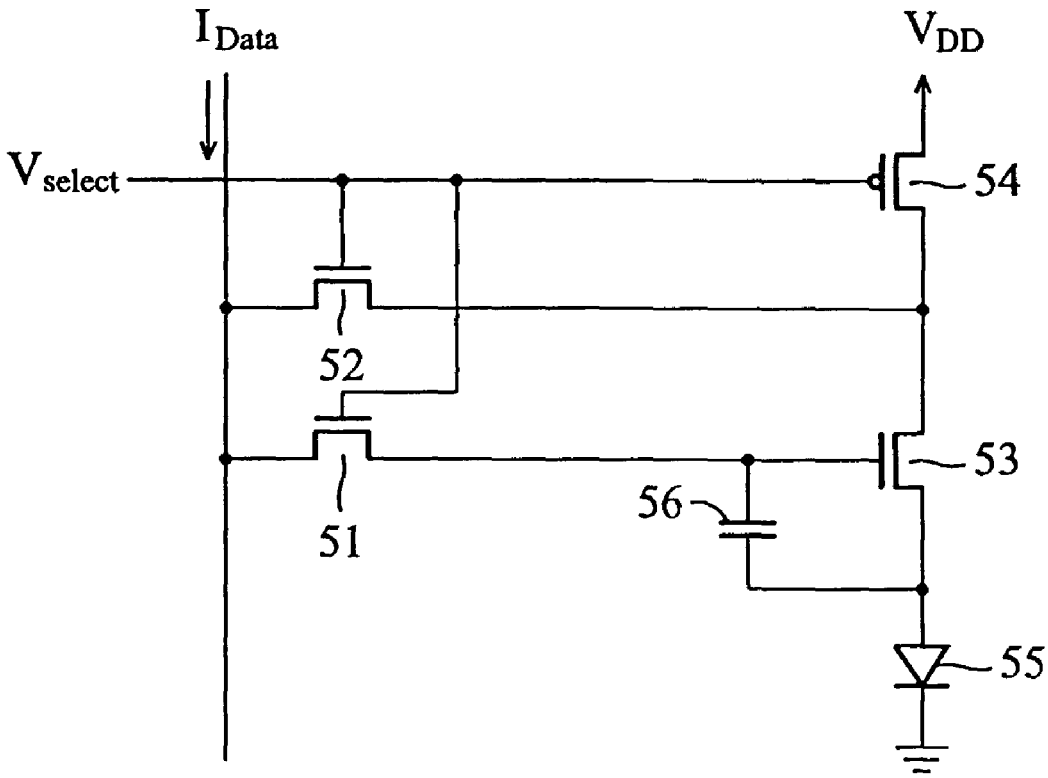
FIG. 5 is a diagram showing an active matrix OLED driving circuit according to a second embodiment of the invention.

FIG. 5 is a diagram showing an active matrix OLED driving circuit according to a second embodiment of the invention. It includes three N-type transistors 51, 52 and 53, a P-type transistors 54, an OLED 55, and a capacitor 56. The transistor 51 has a drain coupled to receive a data signal $I_{Data}$ and a gate coupled to receive a scan signal $V_{select}$. The transistor 52 has a drain coupled to receive the data signal $I_{Data}$ and a gate coupled to receive the scan signal $V_{select}$. The transistor 53 has a drain coupled to the source of the transistor 52 and a gate coupled to the source of the transistor 51. The transistor 54 has a source coupled to receive a power supply voltage $V_{DD}$, and a gate coupled to receive the scan signal $V_{select}$ and a drain coupled to the source of the transistor 52. The OLED 55 has an anode coupled to the source of the transistor 53 and a cathode coupled to the ground. The capacitor 56 is coupled between the gate and source of the transistor 53. Since there are two types of transistors in the driving circuit, the transistor may be poly-Si TFTs.

The capacitor 56 is mainly used for charge storage. During a scan period, the transistors 51 and 52 are turned on by the scan signal $V_{select}$ so that the data signal $I_{Data}$ drives a current through the transistor 53 and charging the capacitor 56. At the end of the scan period, the transistors 51 and 52 are turned off by the scan signal $V_{select}$ so that the current driven by the data signal $I_{Data}$ is cut off. The voltage established by the charges on the capacitor 56 succeeds the data signal $I_{Data}$ to drive the same current through the transistor 53 until the beginning of the next scan period.

By comparing the driving circuits in FIGS. 4 and 5, it is noted that the P-type transistors 41 and 42, and the N-type transistor 44 are substituted by the N-type transistors 51 and 52, and the P-type transistor 54 in the circuit of FIG. 5. The driving circuit in FIG. 5 has the same advantages of that in FIG. 4.

In conclusion, the present invention provides an active matrix OLED display driving circuit. The scan signal is directly fed to the gate of the upper transistor in the LED driving current path and the capacitor is moved to be coupled between the gate and source of the lower transistor, which eliminates the necessity of the inverter or additional control signal, and makes it possible to achieve a driving circuit having a simple circuit structure, small circuit area and low power consumption as well as providing a high contrast ratio.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. An active matrix LED display driving circuit comprising:

a first transistor of a first type having a drain, a source coupled to receive a data signal and a gate coupled to receive a scan signal;

a second transistor of the first type having a drain, a source coupled to receive the data signal and a gate coupled to receive the scan signal;

a third transistor of a second type having a source, a drain coupled to the drain of the second transistor and a gate coupled to the drain of the first transistor;

a fourth transistor of the second type having a drain coupled to receive a first voltage, a gate coupled to receive the scan signal and a source coupled to the drain of the second transistor;

a light emitting diode having an anode coupled to the source of the third transistor and a cathode coupled to receive a second voltage; and a capacitor coupled between the gate and source of the third transistor.

2. The circuit as claimed in claim 1, wherein the first type is P type and the second type is N type.

3. The circuit as claimed in claim 1, wherein the first, second, third and fourth transistor are poly-silicon TFTs.

4. The circuit as claimed in claim 1, wherein the light emitting diode is a organic light emitting diode.

5. The circuit as claimed in claim 1, wherein the first voltage is a power supply voltage $V_{DD}$ and the second voltage is a ground voltage.

6. An active matrix LED display driving circuit comprising:

a first transistor of a first type having a source, a drain coupled to receive a data signal and a gate coupled to receive a scan signal;

a second transistor of the first type having a source, a drain coupled to receive the data signal and a gate coupled to receive the scan signal;

a third transistor of the first type having a source, a drain coupled to the source of the second transistor and a gate coupled to the source of the first transistor;

a fourth transistor of the second type having a drain coupled to receive a first voltage, a gate coupled to receive the scan signal and a drain coupled to the source of the second transistor;

a light emitting diode having an anode coupled to the source of the third transistor and a cathode coupled to receive a second voltage; and a capacitor coupled between the gate and source of the third transistor.

7. The circuit as claimed in claim 6, wherein the first type is P type and the second type is N type.

8. The circuit as claimed in claim 6, wherein the first, second, third and fourth transistor are poly-silicon TFTs.

9. The circuit as claimed in claim 6, wherein the light emitting diode is an organic light emitting diode.

10. The circuit as claimed in claim 6, wherein the first voltage is a power supply voltage $V_{DD}$ and the second voltage is a ground voltage.

* * * * *